US005529539A

United States Patent [19]

Hoffman

[11] Patent Number: 5,529,539

[45] Date of Patent: Jun. 25, 1996

[54] LOOP-O-SWING

[76] Inventor: Roger A. Hoffman, 2041 Billdedman Rd., Bowling Green, Ky. 42101

[21] Appl. No.: 114,849

[22] Filed: Sep. 2, 1993

[51] Int. Cl.[6] ..... A63G 9/00

[52] U.S. Cl. ..... 472/118

[58] Field of Search ..... 472/118

[56] References Cited

U.S. PATENT DOCUMENTS

| | | | |
|---|---|---|---|
| 2,448,325 | 8/1948 | Poorman | 472/118 X |
| 3,186,711 | 6/1965 | Morrow | 472/118 |
| 3,191,932 | 6/1965 | Brilz | 472/118 |
| 3,298,738 | 1/1967 | Shalhoob | 472/118 X |
| 3,838,854 | 10/1974 | Hendrickson | 472/118 |
| 4,138,104 | 2/1979 | D'Amicis | 472/118 |
| 4,382,595 | 5/1983 | Tolar | 472/118 |
| 4,478,409 | 10/1984 | Eads | 472/118 |
| 4,478,410 | 10/1984 | Ziegler | 472/118 |
| 4,966,309 | 10/1990 | Baer | 472/118 |
| 5,067,706 | 11/1991 | Tsai | 472/118 |
| 5,163,828 | 11/1992 | Coddington | 472/118 |
| 5,197,925 | 3/1993 | Cunard | 472/118 |
| 5,197,926 | 3/1993 | Cunard | 472/118 |

*Primary Examiner*—Carl D. Friedman
*Assistant Examiner*—Beth A. Aubrey

[57] ABSTRACT

Materials and arrangements in development for a special swing.

A pair of pyramid style support posts anchored at its prospective plane by means of concrete or plates, said support post secures a horizontal support bar at their tops. The horizontal support bar has its length and the width of the support post, and in its center, two block or sleeve bearings being attached to a pair of upright vertical solid bars spaced in width as that of the seat, in length to that of the height of the swing, incorporating a seat at their prospective lower ends, being threaded to secure the seat and safety straps, and the unique feature is a pair of double-swivel eyes interlocked, with adjustable stops on each upright bar the distance above the seat at hip level.

1 Claim, 1 Drawing Sheet

LOOP-O-SWING

BACKGROUND

1. Field of the Invention

This invention incorporates support post and bars for a special swing.

2. Description of the prior Art

Swings have been in use I'm sure, since, man has felt the fast breeze over his face, or felt the thrill of a sudden fall.

There has been many great swings built to satisfy this desire, too many to try to name a few. This invention I believe will accomplish these feelings and challenge the user, young and old to safely defy The Laws of Gravity, exercise his/her body and at the same time have a "barrel" of fun.

BRIEF DESCRIPTION OF THE DRAWING

FIG. #1 Drawing displays its prospectives and characters of construction, its unbelievable abilities to allow its rider (swinger) to use.

FIG. #2 Allows one to see its profile of construction and assembly.

Figures 1, 2, 3, 4:
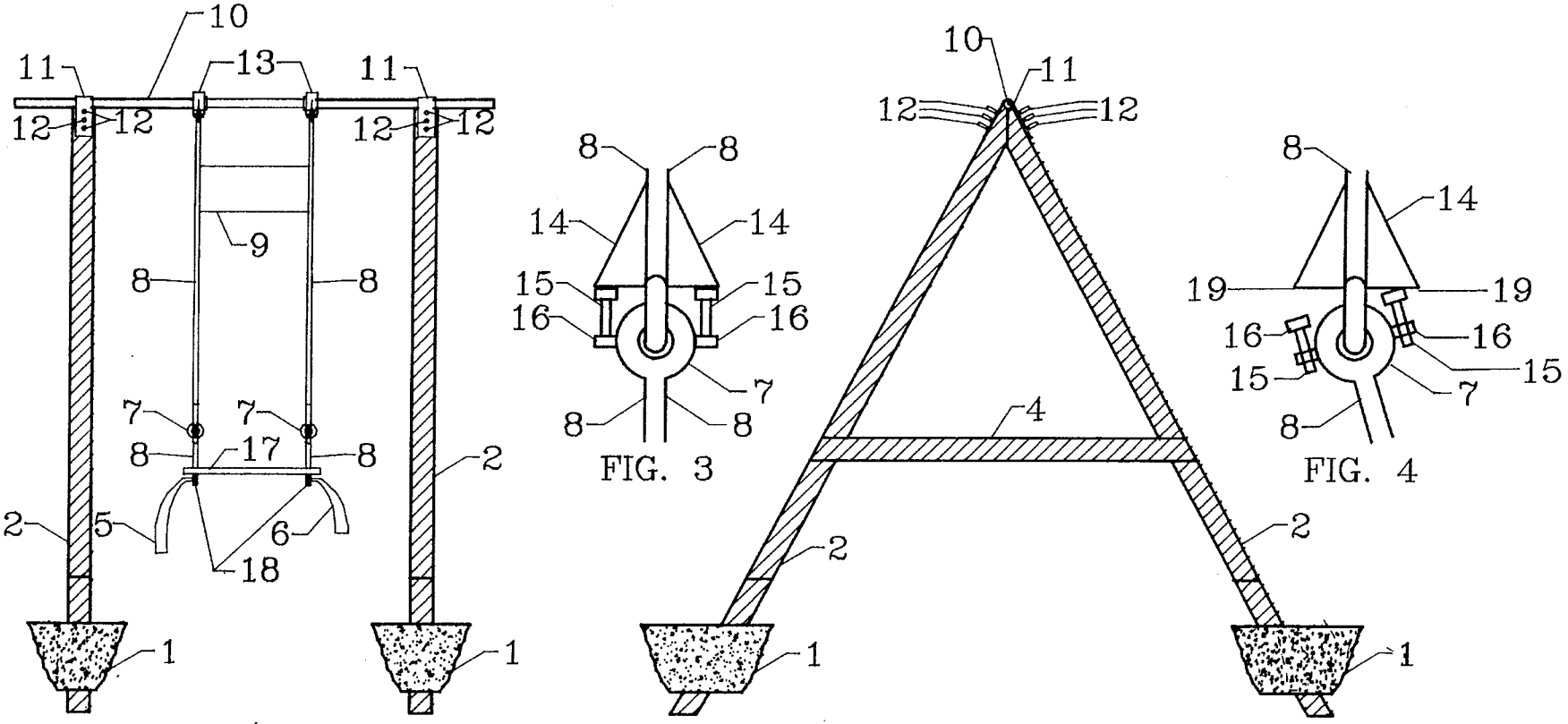

FIG. #3 Displays in detail the unique feature of the double swivel with lock eyes.

FIG. #4 Displays an action view.

DETAILED DESCRIPTION OF THE INVENTION

In making references of the swing, use of FIGS. #1 and #2 combined will be sited, as both figures, wherein like numerals refer to same parts. Also FIGS. #3 and #4 in like manner.

The support post #2 secured at top by strap plates #11 fixed with leg bolts #12, securing horizontal support bar #10, thus #10 horizontal bar supports #8 vertical continuous upright bar #8 being attached to solid support bar #10 by #13 block bearing and/or sleeve bearings for an axis or pivot point. Characterized also is #8 upright bars including at aproximately 10" or hip level up from seat #17 is the "unique" #7 double eye attachment with adjustable swivel lock as per FIG. #3 and #4 respectively.

The two upright bars #8 (lower and upper parts) are attached together by the fixed eyes #7 incorporating #14 stops and #15 as in FIGS. #3 and #4 threaded studs in relation with #16 threaded nuts and sockets #16 as in FIGS. #3 and #4 allowing the swinger (rider) to have the same principle advantage as that with a chain swing—the Flex (push and/or pump) advantage, unlike that of U.S. Pat. No. 4,036,489 with straight up right bars, solid top to bottom, to which this patent incorporates a hand crank, for a second party to assist the swinger (rider) to which the swinger (rider) could not accomplish the 360° complete loop over, using the upright solid bars as in the U.S. Pat. No. 4,036,489 without the aid of the second party—cranking on the horizontal bar assisting in the back and forth motion, until the force-momentum is gained enough until the 360° loop over is accomplished.

Unlike my "Loop-O-Swing" design it includes as before outlined #7 in FIGS. #3 and #4 double swivel eyes with adjustable locks or stops as in FIGS. #3 and #4 to give the swinger (rider) the ability to accomplish the 360° loop.

In FIG. #1 upright bars #8 at its prospective lower end is threaded and with attachments of #18 nuts, the seat #17 is secured along with the safety attachments #5 and #6 belts.

The seat #17 in FIG. #1 is drilled making a hole the size of the diameter of the upright bars and a part spacing the width equal to that of the #8 upright bars. Also the #8 upright bars in the FIG. #1 illustration incorporates a plate #9 in gauge thickness, enough to stabilize together the two upright bars #8 to prevent any twisting as would be the case of an ordinary chain swing.

The #4 member in FIG. #2 attaches and secures the pyramid upright supports #2 in FIG. #1 in FIG. #2, together to make a solid and safe swing. To ensure a safe and enjoyable swing #1 anchorments in FIG. #1 attach ##2 in FIG. #1 and #2 in FIG. #2 rigidly to the ground.

I claim:

1. A Loop-O-Swing comprising:

a pair of pyramid-shaped support posts, each support post having an apex;

a horizontal support bar supported by said support posts on said apex;

a pair of vertical bars, each vertical bar having an upper and lower end, each said upper end attached to said support bar via roller or sleeve bearings; and a seat attached to the lower ends of the vertical bars, said seat having safety straps;

said upper and lower ends connected via upper and lower interlocking eyes comprising a swivel adjustable stops, said upper eye comprising at least one shoulder, said lower eye comprising at least one threaded nut and bolt connection, said at least one nut and bolt combination being adjustable to abut said at least one shoulder.

* * * * *